US009629437B2

(12) United States Patent
Shen

(10) Patent No.: US 9,629,437 B2
(45) Date of Patent: Apr. 25, 2017

(54) COSMETIC CONTAINER

(71) Applicant: Mu-Chuan Shen, Tainan (TW)

(72) Inventor: Mu-Chuan Shen, Tainan (TW)

( * ) Notice: Subject to any disclaimer, the term of this patent is extended or adjusted under 35 U.S.C. 154(b) by 137 days.

(21) Appl. No.: 14/595,332

(22) Filed: Jan. 13, 2015

(65) Prior Publication Data

US 2015/0122697 A1 May 7, 2015

Related U.S. Application Data

(63) Continuation-in-part of application No. 14/146,860, filed on Jan. 3, 2014, now abandoned.

(30) Foreign Application Priority Data

Sep. 24, 2013 (TW) ..... 102217837 U
Sep. 24, 2014 (TW) ..... 103216947 U

(51) Int. Cl.

| | |
|---|---|
| ***A45D 33/00*** | (2006.01) |
| ***A45D 33/26*** | (2006.01) |
| ***B65D 51/26*** | (2006.01) |
| ***A45D 40/00*** | (2006.01) |
| *A45D 40/10* | (2006.01) |

(52) U.S. Cl.

CPC ..... *A45D 33/003* (2013.01); *A45D 33/00* (2013.01); *A45D 33/26* (2013.01); *A45D 40/0068* (2013.01); *B65D 51/26* (2013.01); *A45D 2040/105* (2013.01)

(58) Field of Classification Search

CPC .... A45D 33/00; A45D 33/003; A45D 33/006; A45D 40/0068; B65D 51/26

USPC ..... 132/286, 293–295, 298–300, 307; 215/231; 220/578

See application file for complete search history.

(56) References Cited

U.S. PATENT DOCUMENTS

| | | | | |
|---|---|---|---|---|
| 336,690 | A * | 2/1886 | Bellamy | B65D 51/26 217/86 |
| 516,303 | A * | 3/1894 | Goldwater | B65D 81/266 215/231 |
| 1,084,114 | A * | 1/1914 | Scheier | B65D 51/26 215/231 |
| 1,183,714 | A | 5/1916 | Armstrong | |
| 1,342,321 | A | 6/1920 | Beler | |

(Continued)

FOREIGN PATENT DOCUMENTS

| | | | |
|---|---|---|---|
| DE | 8700756 | U1 | 5/1987 |
| EP | 2 777 429 | A1 | 9/2014 |
| JP | 2001-299445 | A | 10/2001 |

*Primary Examiner* — Tatiana Nobrega
(74) *Attorney, Agent, or Firm* — Hamre, Schumann, Mueller & Larson, P.C.

(57) ABSTRACT

A cosmetic container includes a container body that has a receiving space with a top opening, the receiving space being adapt to receive a cosmetic product, a lid unit that is connected to the container body and that openably covers the top opening of the receiving space; and a press unit that includes a blocking member which is removably and pluggingly inserted into the receiving space for blocking the cosmetic product within the receiving space, and an abutment member which protrudes from the lid unit to abut against the blocking member. When the lid unit is released from the top opening of the receiving space, the abutment member is driven by and moves together with the lid unit away from, the receiving space.

5 Claims, 6 Drawing Sheets

(56) References Cited

U.S. PATENT DOCUMENTS

| | | | | |
|---|---|---|---|---|
| 1,654,914 | A * | 1/1928 | Beery | B65D 81/22 215/231 |
| 1,818,924 | A * | 8/1931 | Basmadjian | B65D 81/245 215/231 |
| 2,222,042 | A * | 11/1940 | Nitardy | B65D 51/26 206/540 |
| 5,297,694 | A | 3/1994 | Bontemps | |
| 5,492,426 | A | 2/1996 | Gueret | |
| 5,988,185 | A * | 11/1999 | Gueret | A45D 40/22 132/294 |
| 6,164,293 | A | 12/2000 | Gueret | |
| 7,121,420 | B2 | 10/2006 | Baudin | |
| 7,322,478 | B2 * | 1/2008 | Goto | A45D 33/006 132/294 |
| 7,481,229 | B2 | 1/2009 | Habatjou | |
| 2003/0155358 | A1 * | 8/2003 | Goto | A45D 33/006 220/23.87 |
| 2004/0139980 | A1 * | 7/2004 | Habatjou | A45D 33/006 132/300 |
| 2010/0307521 | A1 | 12/2010 | Pires et al. | |

* cited by examiner

COSMETIC CONTAINER

CROSS-REFERENCE TO RELATED APPLICATION

This application is a continuation-in-part of U.S. patent application Ser. No. 14/146,860 (hereinafter referred to as the '860 application) and claims priority of Taiwanese Application no. 103216947, filed on Sep. 24, 2014. The '860 application, entitled "Cosmetic Container," was filed on Jan. 3, 2014 and claims priority of Taiwanese Application no. 102217837, filed on Sep. 24, 2013.

FIELD OF THE INVENTION

The invention relates to a container, more particularly to a cosmetic container having a press unit for blocking a cosmetic product received in the cosmetic container.

BACKGROUND OF THE INVENTION

Generally, a conventional cosmetic container for storing a powdered cosmetic product, such as a face powder, includes a container body provided with a top opening and a lid. The container body receives the cosmetic product. The lid removably covers the top opening of the container body in order to prevent leakage of cosmetic material from the container body.

However, when the conventional cosmetic container is turned upside down, the cosmetic product tends to dislocate and disperse in the container body. Thereafter, when a user removes the lid from the container body to use the cosmetic product, cosmetic material is likely to be stuck on the lid or scatter in all directions, staining the user's hands or clothes, or even be undesirably inhaled into the human system.

SUMMARY OF THE INVENTION

Therefore, an object of the present invention is to provide cosmetic container that can overcome at least one of the aforesaid drawbacks of the prior art.

According to the present invention, a cosmetic container includes a container body, a lid unit, and a press unit.

The container body has a receiving space with a top opening. The receiving space is adapted to receive a cosmetic product.

The lid unit is connected to the container body and openably covers the top opening of the receiving space.

The press unit includes a blocking member which is removably and pluggingly inserted into the receiving space for blocking the cosmetic product within the receiving space, and an abutment member which protrudes from the lid unit to abut against the blocking member.

When the lid unit is released from the top opening of the receiving space, the abutment member is driven by and moves together with the lid unit away from, the receiving space.

BRIEF DESCRIPTION OF THE DRAWINGS

Other features and advantages of the present invention will become apparent in the following detailed description of the embodiments with reference to the accompanying drawings, of which.

DETAILED DESCRIPTION OF THE EMBODIMENTS

Figure 1:
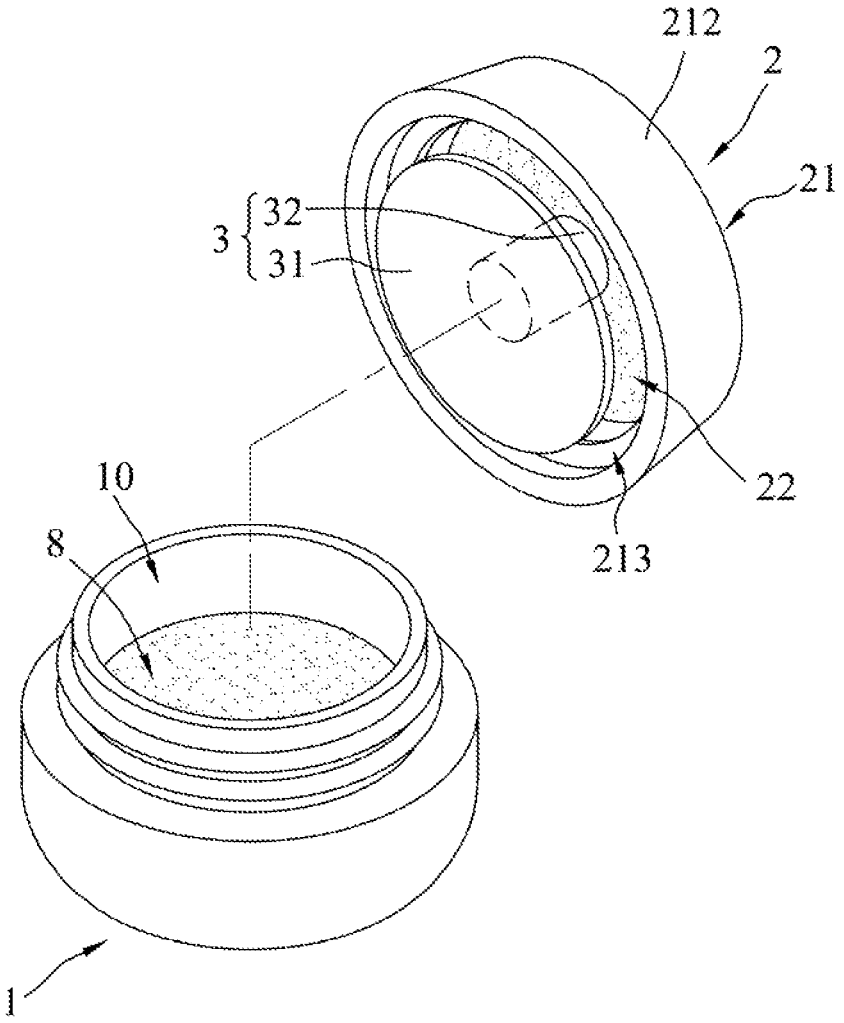
FIG. 1 is an exploded perspective view illustrating a first embodiment of a cosmetic container according to the present invention.
Figure 2:
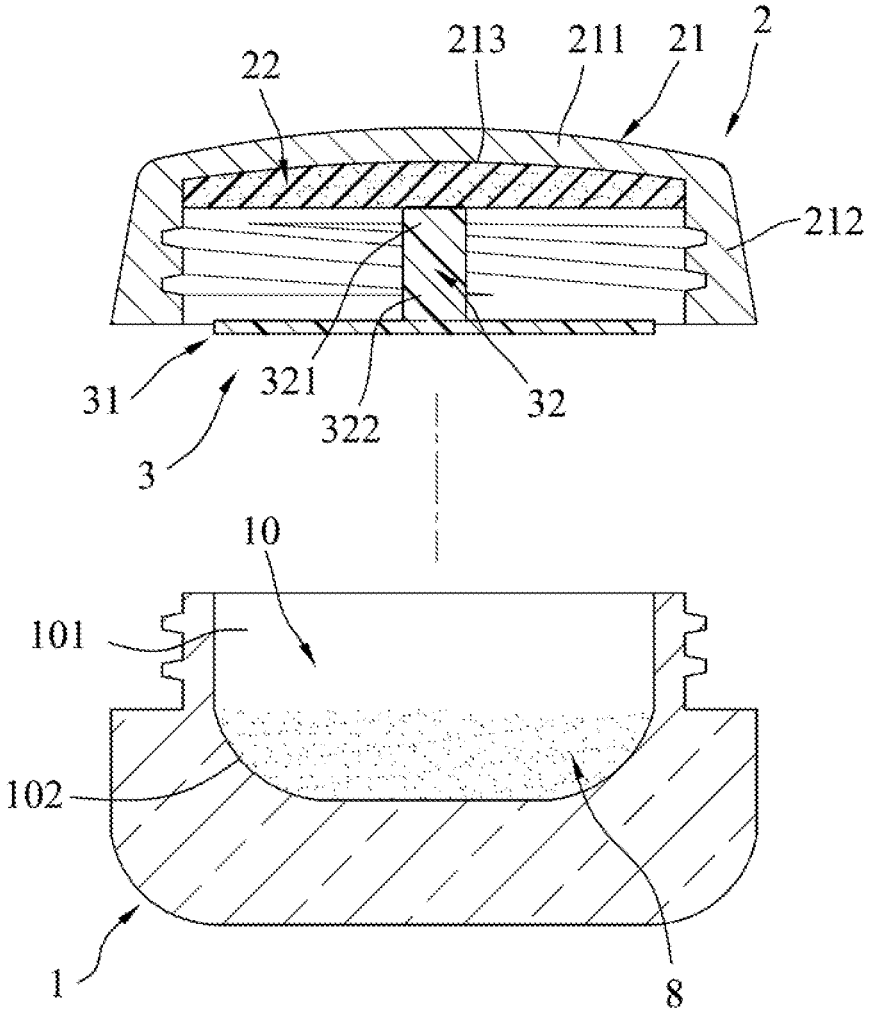
FIG. 2 is an exploded sectional view of the first embodiment.
Figure 3:
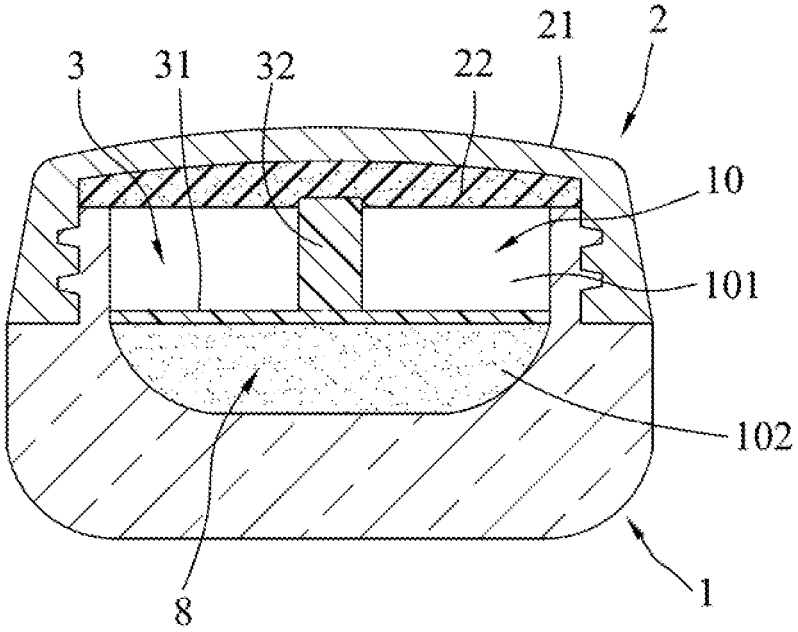
FIG. 3 is a sectional view of the first embodiment.

Referring to FIGS. 1 to 3, the first embodiment of a cosmetic container according to the present invention is illustrated. The cosmetic container is adapted to receive a cosmetic product 8, which may be in powder or cream form. The cosmetic container includes a container body 1, a lid unit 2, and a press unit 3.

The container body 1 has a receiving space 10 with a tap opening that is adapted to receive a cosmetic product 8. The receiving space 10 has an upper section 101 that is proximate to the top opening of the receiving space 10, and a lower section 102 that is lower than and tapered downwardly from the upper section 101 for receiving the cosmetic product 8.

The lid unit 2 openably covers the top opening of the receiving space 10 and has a lid body 21 that openably covers the top opening, and a resilient member 22 that is positioned on an inner surface of the lid body 21. The lid body 21 has a top wall 211 that is formed with the inner surface, a thread wall 212 that extends circumferentially and downwardly from the top wall 211 and that is threadedly mounted on a top of the container body 1. The top wall 211 and the thread wall 212 cooperatively define an insertion space 213 for insertion of the resilient member 22 therein. The top of the container body 1 abuts against the resilient member 22 when the lid body 21 threadedly covers the container body 1 so that the receiving space 10 is sealed.

In this embodiment, the lid body 21 is detachably connected to the container body 1 in a threaded engagement. However, the connection between the lid body 21 and the container body 1 is not limited to the threaded engagement. In an alternative embodiment, the lid body 21 may be designed to be undetachably and pivotally mounted on the container body 1 as long as the lid body 21 openably covers the receiving space 10 of the container body 1.

In the first embodiment, the press unit 3 includes a blocking member 31 which is removably and pluggingly inserted into the receiving space 10 for blocking the cosmetic product 8 within the receiving space 10, and an abutment member 32 which protrudes from the lid unit 2 to abut against the blocking member 31.

The blocking member 31 has a width that is smaller than that of the upper section 101 and that is greater than that of the lower section 102. The blocking member 31 is pressable downward against and fitted tightly in a top of the lower section 102 for blocking a top of the cosmetic product 8 within the lower section 102. For instance, the blocking member 31 may be disc-shaped and have a diameter smaller than that of the upper section 101 and greater than that of the maximum diameter of the lower section 102.

The abutment member 32 has a first end 321 that is secured to the lid unit 2, and a second end 322 that is opposite to the first end 321 and that is connected to the blocking member 31. Specifically, the abutment member 32 is secured to the resilient member 22 so as to be resiliently pressable against the blocking member 31. Alternatively, the abutment member 32 and the blocking member 31 may be formed as one piece. The first end 321 of the abutment member 32 may be adhesively secured to the resilient member 22, for instance, by adhesives or heat fusion. However, the method for securing the first end 321 to the resilient member 22 is not limited by this embodiment, and the abutment member 32, the resilient member 22 and the blocking member 31 may also be formed as one piece.

In this embodiment, by way of the structural arrangement of the lid unit 2, the abutment member 32 and the blocking member 31, when the lid unit 2 is removed from the top opening of the receiving space 10, not only the abutment member 32, but also the blocking member 31 are driven by and move together with the lid unit 2 away from the receiving space 10. In other words, the press unit 3 is able to be entirely driven by and moved together with the lid unit 2 away from the receiving space 10. Thereby, the top opening of the receiving space 10 is exposed and the cosmetic product 8 received therein is ready for use.

When the cosmetic product 8 is not in use, the blocking member 31 may be aligned with and plugged into the receiving space 10 so as to threadedly cover the lid unit 2 on the container body 1. Meanwhile, the abutment member 32 secured to the resilient member 22 resiliently presses the blocking member 31 downward to be tightly fitted on the top of the lower section 102 so as to block the cosmetic product 8 received therein. Therefore, when the cosmetic container is inadvertently overturned and rolls, the cosmetic product 3 blocked inside the lower section 102 by the blocking member 31 is able to be kept from being dislocated or scattered around in the receiving space 10. Furthermore, the cosmetic product 8 may be compressed into a solid block through pressure applied by the blocking member 31, making the cosmetic product 8 more convenient to use.

Figure 4:
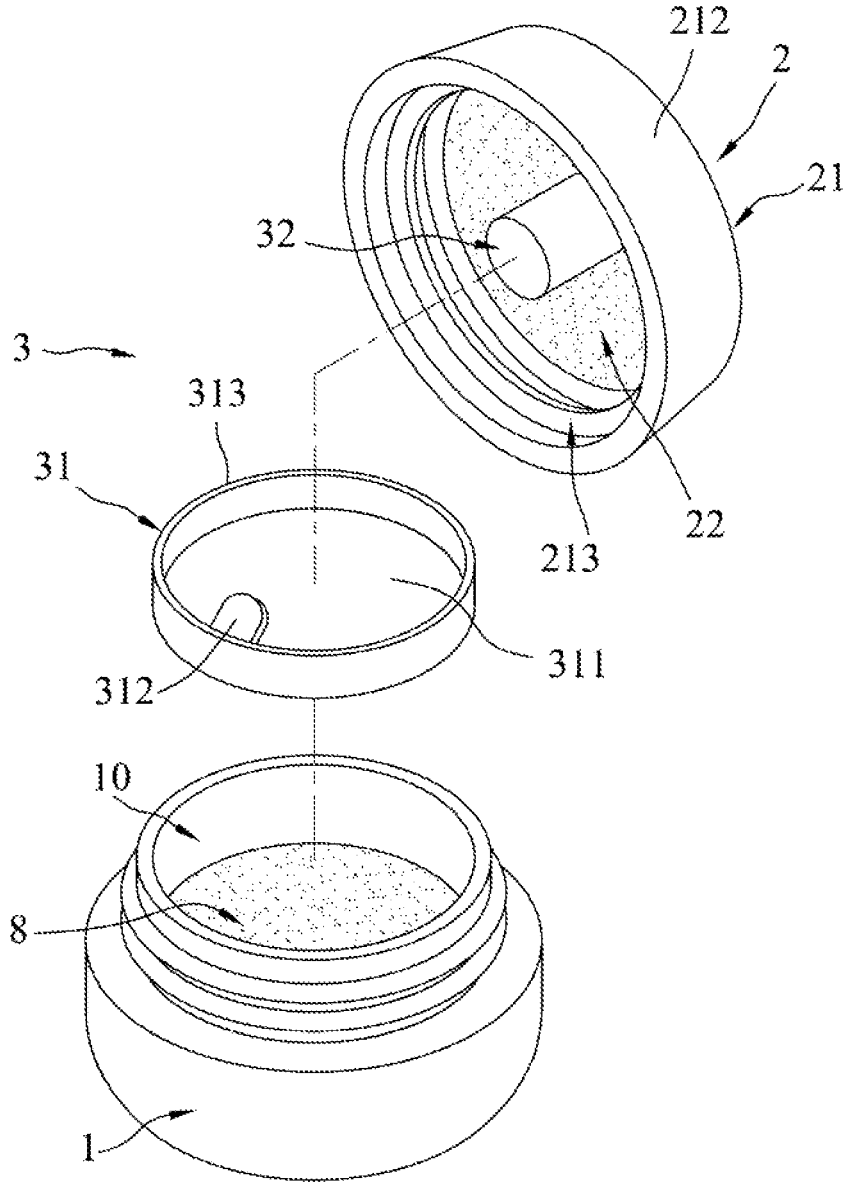
FIG. 4 is an exploded perspective view illustrating a second embodiment of the cosmetic container according to the present invention.
Figure 5:
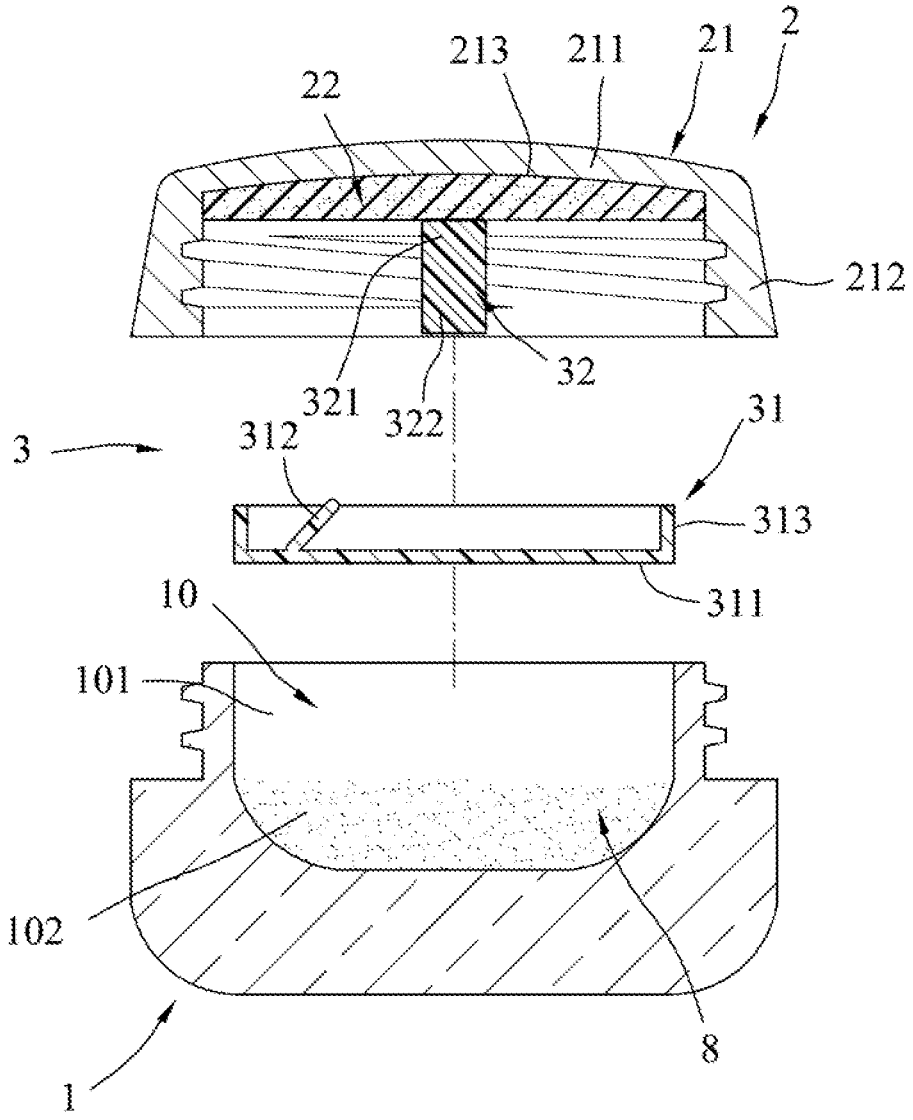
FIG. 5 is an exploded sectional view of the second embodiment.
Figure 6:
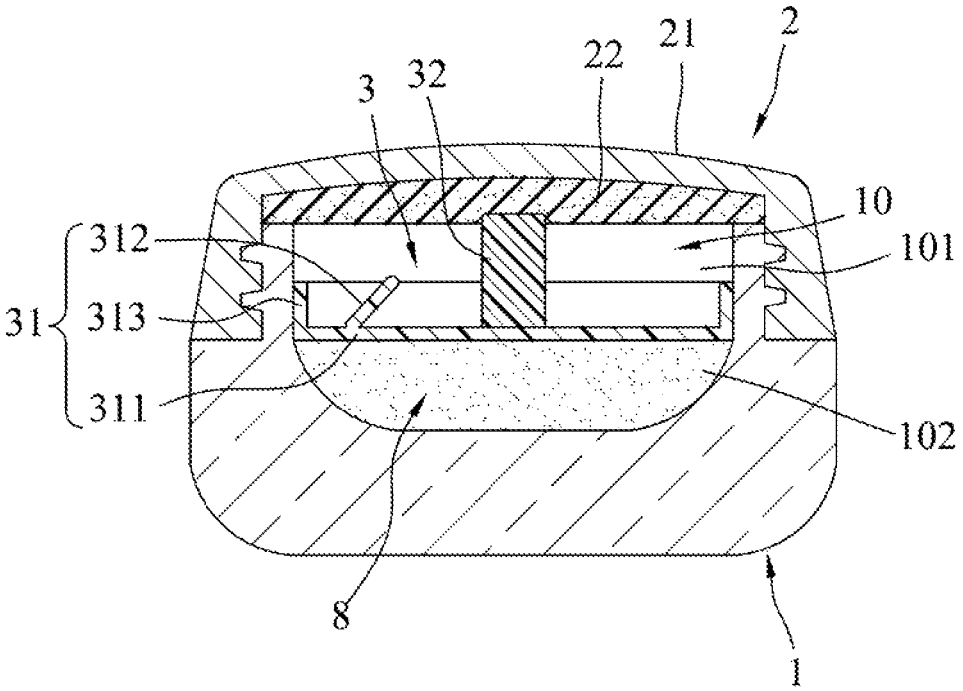
FIG. 6 is a sectional view of the second embodiment.

Referring to FIGS. 4 to 6, the second embodiment of a cosmetic container according to the present invention is illustrated. The second embodiment has a structure similar to that of the first embodiment except that the blocking member 31 of the press unit 3 is separated from the second end 322 of the abutment member 32. In this embodiment, the blocking member 31 has a blocking plate 311 that is pressed by abutment of the abutment member 32 for blocking the cosmetic product 8 within the receiving space 10, a tab 312 that is secured to a top surface of the blocking plate 311, and a lip 313 that extends upwardly and annularly around a perimeter of the top surface of the blocking plate 311.

In this embodiment, the tab 312 may be formed with the blocking plate 311 as one piece, and protrudes on the top of the blocking plate 311 for convenience in removing the blocking member 31 from the top opening of the receiving space 10 of the container body 1. The tab 312 is free from abutment by the abutment member 32 when the cosmetic container is closed.

In this embodiment, when the lid unit 2 is removed, from the top opening of the receiving space 10 to drive movement of the abutment member 32 away from the receiving space 10 together therewith, the blocking member 31 stays in the receiving space 10, The user may then grab and pull the tab 312 to remove the blocking member 31 from the receiving space 10 to use the cosmetic product 8.

In view of the foregoing, by virtue of the arrangement of the blocking member 31 and the abutment member 32, the cosmetic product 8 is rendered immobile within the receiving space 10 and is thereby prevented from scattering. Furthermore, the cosmetic product 8 may be compressed into a solid block by the press from the blocking member 31, maintaining the integrity of the cosmetic product 8 and making the cosmetic product 8 more convenient to use.

While the present invention has been described in connection with what is considered the most practical embodiments, it is understood that this invention is not limited to the disclosed embodiments but is intended to cover various arrangements included within the spirit and scope of the broadest interpretation so as to encompass ail such modifications and equivalent arrangements.

What is claimed is:

1. A cosmetic container comprising:

a container body that has a receiving space with a top opening, the receiving space being adapted to receive a cosmetic product;

a lid unit that is connected to the container body and that openably covers the top opening of the receiving space; and a press unit that includes:

a blocking member which is removably and pluggingly inserted into the receiving space for blocking the cosmetic product within the receiving space, and an abutment member that is fixedly coupled to the lid unit and which protrudes from the lid unit to abut against the blocking member, wherein the lid unit includes:

a lid body that openably covers the top opening of the receiving space;

a resilient member that is positioned on an inner surface of the lid body, the abutment member is secured to the resilient member in an un-deformed manner so as to be resiliently pressable downwardly against the blocking member;

a top wall that is formed with the inner surface;

a thread wall that extends circumferentially and downwardly from the top wall and is threadedly mounted on a top of the container body, the top wall and the thread wall cooperatively define an insertion space for insertion of the resilient member therein, and the top of the container body abuts against the resilient member when the lid body threadedly covers the container body, and the receiving space has an upper section that is proximate to the top opening of the receiving space, and a lower section that is lower than and tapered downwardly from the upper section for receiving the cosmetic product and the blocking member having a width that is smaller than that of the upper section and that is greater than that of the lower section, the blocking member being pressed downward against and fitted tightly in a top of the lower section for blocking the cosmetic product within the lower section wherein when the lid unit is released from the top opening of the receiving space, the abutment member moves with the lid unit away from the receiving space.

2. The cosmetic container of claim 1, wherein the abutment member has a first end that is secured to the lid unit and a second end that is opposite to the first end and is connected to the blocking member, wherein, the blocking member moves with the abutment member away from the receiving space when the lid unit is released from the top opening of the receiving space.

3. The cosmetic container of claim 1, wherein the blocking member has a blocking plate that is pressed by abutment of the abutment member for blocking the cosmetic product within the receiving space, and a tab that is secured to a top surface of the blocking plate.

4. The cosmetic container of claim 3, wherein the blocking member has a lip that extends upwardly and annularly around a perimeter of the top surface of the blocking plate.

5. The cosmetic container of claim 3, wherein the receiving space has an upper section that is proximate to the top opening of the receiving space, and a lower section that is lower than and tapered downwardly from the upper section for receiving the cosmetic product, and the blocking plate having a width that is smaller than that of the upper section and that is greater than that of the lower section, the blocking plate being pressed downward against and fitting tightly in a top of the lower section for blocking the cosmetic product within the lower section.

* * * * *